US007479767B2

(12) United States Patent
Kato

(10) Patent No.: US 7,479,767 B2
(45) Date of Patent: Jan. 20, 2009

(54) POWER SUPPLY STEP-DOWN CIRCUIT AND SEMICONDUCTOR DEVICE

(75) Inventor: Tatsuo Kato, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 123 days.

(21) Appl. No.: 11/704,952

(22) Filed: Feb. 12, 2007

(65) Prior Publication Data

US 2008/0061749 A1 Mar. 13, 2008

(30) Foreign Application Priority Data

Sep. 12, 2006 (JP) ..... 2006-247106

(51) Int. Cl.
*G05F 1/613* (2006.01)
*G05F 3/16* (2006.01)

(52) U.S. Cl. ..... 323/223; 323/272; 323/284; 323/285

(58) Field of Classification Search ..... 323/271, 323/259, 284, 285, 223, 272
See application file for complete search history.

(56) References Cited

U.S. PATENT DOCUMENTS 5,006,782 A * 4/1991 Pelly ..... 323/225
5,932,995 A * 8/1999 Wagoner ..... 323/222
6,211,657 B1 * 4/2001 Goluszek ..... 323/272
6,538,905 B2 * 3/2003 Greenfeld et al. ..... 363/17
6,696,882 B1 * 2/2004 Markowski et al. ..... 327/531
6,784,644 B2 * 8/2004 Xu et al. ..... 323/225
6,798,177 B1 * 9/2004 Liu et al. ..... 323/222
2002/0036486 A1 * 3/2002 Zhou et al. ..... 323/272

FOREIGN PATENT DOCUMENTS

JP 05-021738 1/1993

* cited by examiner

*Primary Examiner*—Bao Q Vu
(74) *Attorney, Agent, or Firm*—Arent Fox LLP

(57) ABSTRACT

A power supply step-down circuit is adapted to a semiconductor integrated circuit having a first operation mode and a second operation mode having a smaller current consumption than the first operation mode. The power supply step-down circuit includes a first step-down circuit activated only during the first operation mode to step down an input power supply voltage to an output voltage, a second step-down circuit provided integrally with the first step-down circuit and activated only during the second operation mode to step down the input power supply voltage to an output voltage, an output terminal to output the output voltage of one of the first and second step-down circuits that is activated, and an output circuit to maintain the output voltage that is output from the output terminal lower than the input power supply voltage for a first predetermined time when an operation mode makes a transition from the first operation mode to the second operation mode.

16 Claims, 7 Drawing Sheets

POWER SUPPLY STEP-DOWN CIRCUIT AND SEMICONDUCTOR DEVICE

BACKGROUND OF THE INVENTION

1. Field of the Invention

The present invention generally relates to power supply step-down circuits and semiconductor devices, and more particularly to a power supply step-down circuit for stepping down an input power supply voltage and to a semiconductor device having such a power supply step-down circuit.

2. Description of the Related Art

Due to improvements made in the semiconductor producing processes that form extremely small patterns, the size of semiconductor integrated circuits (LSI circuits) within the semiconductor device has become extremely small, and voltages that may be applied to the LSI circuits have become low. On the other hand, from the point of view of the user of the LSI circuit, there are demands to use the same power supply voltage as the conventional LSI circuit, because of the desire to use the same power supply unit or the like as the conventional LSI circuit. Accordingly, a power supply step-down circuit is provided within the LSI circuit, so that a relatively low voltage is supplied within the LSI circuit even when an external power supply voltage applied to the LSI circuit is relatively high.

The current consumption of the LSI circuit is determined by the current value which changes proportionally to a frequency of a clock supplied to a circuit part within the LSI circuit and in synchronism with the clock. For this reason, it is necessary to set the current consumption of the power supply step-down circuit to a relatively large value on the order of several hundred μA to several mA, for example, so that a high reaction speed of the power supply step-down circuit is obtainable. In this specification, such an operation mode of the LSI circuit will be referred to as a normal operation mode.

On the other hand, there are LSI circuits that have an operation mode for reducing the current consumption by stopping the supply of the clock when the LSI circuits do not need to operate. In this specification, such an operation mode of the LSI circuit will be referred to as a standby mode. One example of the LSI circuit having the standby mode is an LSI circuit that includes a CPU and/or logic circuit. Normally, the standby mode requires the supply of the clock to be stopped, and the current consumption of the LSI circuit to be constant and on the order of approximately 10 μA to approximately 1 μA or less. For this reason, in the standby mode, it is not possible to step down the input power supply voltage using the power supply step-down circuit having the relatively large current consumption on the order of several hundred μA to several mA, for example.

Accordingly, a step-down circuit for the normal operation mode and a step-down circuit for the standby mode are provided in the conventional LSI circuit, and the step-down circuit for the standby mode is constantly operated. In the normal operation mode, the step-down circuit for the normal operation mode is operated in addition to the step-down circuit for the standby mode. Hence, the current consumption of the power step-down circuit part as a whole is reduced in the standby mode.

But when the step-down circuit for the normal operation mode and the step-down circuit for the standby mode are provided separately within the LSI circuit, there is a limit to reducing the area occupied by the step-down circuit part as a whole. Hence, it is conceivable to provide a single power step-down circuit integrally having the step-down circuit for the normal operation mode and the step-down circuit for the standby mode. In this conceivable case, there is a circuit part that may be used in common between the step-down circuit for the normal operation mode and the step-down circuit for the standby mode, thereby enabling reduction of the area occupied by the power step-down circuit as a whole. The step-down circuit for the normal operation mode and the step-down circuit for the standby mode may be switched depending on the operation mode of the LSI circuit so that only one of the step-down circuits operates at time. Since the current consumption of the LSI circuit in the standby mode is constant and small, the step-down circuit for the standby mode may have a relatively slow reaction speed, and it is possible to reduce the current consumption of the step-down circuit for the standby mode.

FIG. 1 is a circuit diagram showing a conceivable LSI circuit that is provided with a single power supply step-down circuit integrally having a step-down circuit for normal operation mode and a step-down circuit for standby mode.

The LSI circuit includes input terminals 1 and 2, a single power supply step-down circuit 10, and an output terminal 9 that are connected as shown in FIG. 1. The power supply step-down circuit 10 integrally has a step-down circuit 7 for the normal operation mode and a step-down circuit 8 for the standby mode. The power supply step-down circuit 10 includes a constant voltage source 3, a differential amplifier (or an operational amplifier) 4, an output transistor 5, an inverter, and the step-down circuits 7 and 8. In this particular case, the output transistor 5 is formed by a P-channel transistor. An input power supply voltage is input to the input terminal 1, and a mode signal that indicates the operation mode of the LSI circuit is input to the input terminal 2.

For example, the mode signal that is input to the input terminal 2 has a low level in the normal operation mode, and a bias current within the differential amplifier 4 and the constant voltage source 3 becomes high, to thereby select the step-down circuit 7 for the normal operation mode having a low resistance. Since the bias current is high, the operation speed of the differential amplifier 4 becomes high, and the resistance of the differential amplifier 4 becomes low. Consequently, the charging and discharging speeds of the parasitic capacitance at a node N101 that connects the differential amplifier 4 and the step-down circuit 7 for the normal operation mode becomes high, and the reaction speed of the power supply step-down circuit 10 as a whole becomes relatively high, but the current consumption of the power supply step-down circuit 10 as a whole becomes relatively large.

On the other hand, when the mode signal having a high level and indicating the standby mode is input to the input terminal 2, the bias current within the differential amplifier 4 and the constant voltage source 3 becomes low, to thereby select the step-down circuit 8 for the standby mode having the high resistance. Since the bias current is low, the current consumption of the differential amplifier 4 becomes small, but the reaction speed of the differential amplifier 4 becomes low. Furthermore, because the differential amplifier 4 has a high resistance, the current consumption of this circuit part becomes small. However, the charging and discharging speeds of the parasitic capacitance at the node N101 becomes low, and the reaction speed of the power supply step-down circuit 10 as a whole becomes relatively low, but the current consumption of the power supply step-down circuit 10 as a whole becomes relatively small.

Next, a description will be given of the operation of the power supply step-down circuit 10 when the operation mode of the LSI circuit is switched from the standby mode to the normal operation mode.

FIG. 2 is a timing chart for explaining the operation of the power supply step-down circuit 10 shown in FIG. 1. In FIG. 2, (a) shows the mode signal, (b) shows the clock that is supplied to the circuit part within the LSI circuit, (c) shows an output current of the power supply step-down circuit 10, (d) shows a voltage at a node N100 connecting the differential amplifier 4 and a gate of the output transistor 5, and (e) shows an output voltage (stepped down power supply voltage) that is output from the output terminal 9. FIG. 2 shows a case where the operation mode of the LSI circuit undergoes a transition from the normal operation mode to the standby mode.

As shown in FIG. 2, the during the low-level period of the mode signal that indicates the normal operation mode and is input to the input terminal 2, the clock is supplied to the circuit part within the LSI circuit. In this normal operation mode, the LSI circuit is in a state where the current consumption thereof is large, that is, the output current of the power supply step-down circuit 10 is high.

On the other hand, when the mode signal that is input to the input terminal 2 makes a transition to the high level indicating the standby mode, the supply of the clock within the LSI circuit stops, and the output current of the power supply step-down circuit 10 rapidly decreases as indicated by an arrow in FIG. 2(*c*). In this state, although the voltage at the node N100 connecting to the gate of the output transistor 5 should rise immediately so that the output voltage from the output terminal 9 will not change before and after the operation mode switches, the switching to the step-down circuit 8 for the standby mode having the relatively slow reaction speed is already made in the power supply step-down circuit 10, and it takes time for the voltage at the node N100 to rise.

As a result, even though the output current flowing to the output terminal 9 decreases, the voltage at the node N100 remains low. Consequently, an excessively amount of current flows to the output terminal 9 to increase the output voltage that is output from the output terminal 9, and in a worst case scenario, the output voltage rises to the same potential as the input power supply voltage that is input to the input terminal 1. If the output voltage rises to the same potential as the input power supply voltage, the voltage at the node N100 will cause the output transistor 5 to completely turn OFF, and the output voltage will decrease depending on the current consumption of the LSI circuit. But since the current consumption of the LSI circuit in the standby mode is small, it takes time for the output voltage to drop to the original or proper potential.

For example, a Japanese Laid-Open Patent Application No.5-21738 proposes a power supply voltage step-down circuit for providing a stable internal power supply voltage regardless of a change in the power consumption within the LSI circuit.

Therefore, in the case of the conceivable LSI circuit shown in FIG. 1 in which the area occupied by the power supply step-down circuit is reduced by providing a single power supply step-down circuit that integrally has the step-down circuit for the normal operation mode and the step-down circuit for the standby mode, the output voltage may assume the same potential as the input power supply voltage for a long time when the operation mode of the LSI circuit makes a transition from the normal operation mode to the standby mode. But when the output voltage becomes the same potential as the input power supply voltage for the long time, a relatively high input power supply voltage is applied to the circuit part within the LSI circuit, which originally should not be applied with the input power supply voltage. For this reason, there were problems in such a case that the reliability of the LSI circuit will deteriorate, and the serviceable life of the LSI circuit will be shortened.

SUMMARY OF THE INVENTION

Accordingly, it is a general object of the present invention to provide a novel and useful power supply step-down circuit and semiconductor device, in which the problems described above are suppressed.

Another and more specific object of the present invention is to provide a power supply step-down circuit and a semiconductor device, which can maintain the reliability and the serviceable life of the LSI circuit, even with respect to the LSI circuit provided with a single power supply step-down circuit that integrally has the step-down circuit for the normal operation mode and the step-down circuit for the standby mode.

Still another object of the present invention is to provide a power supply step-down circuit adapted to a semiconductor integrated circuit having a first operation mode and a second operation mode having a smaller current consumption than the first operation mode, comprising a first step-down circuit, activated only during the first operation mode, and configured to step down an input power supply voltage to an output voltage; a second step-down circuit, provided integrally with the first step-down circuit and activated only during the second operation mode, and configured to step down the input power supply voltage to an output voltage; an output terminal configured to output the output voltage of one of the first and second step-down circuits that is activated, the first step-down circuit having a lower resistance, higher reaction speed and a larger current consumption compared to the second step-down circuit; and an output circuit configured to maintain the output voltage that is output from the output terminal lower than the input power supply voltage for a first predetermined time when an operation mode makes a transition from the first operation mode to the second operation mode, so that the output voltage that is output from the output terminal does not become the same potential as the input power supply voltage for a second predetermined time or longer. According to the power supply step-down circuit of the present invention, it is possible to maintain the reliability and the serviceable life of the semiconductor integrated circuit, even with respect to the semiconductor integrated circuit provided with a single power supply step-down circuit that integrally has the step-down circuit for the normal operation mode and the step-down circuit for the standby mode.

The power supply step-down circuit may further comprise a first input terminal configured to receive a mode signal that indicates whether the operation mode is the first operation mode or the second operation mode, and to supply the mode signal to the first and second step-down circuits and the output circuit.

A further object of the present invention is to provide a semiconductor device comprising the power supply step-down circuit described immediately above, and a circuit part configured to receive the output voltage that is output from the output terminal and includes a CPU and/or a logic circuit. According to the semiconductor device of the present invention, it is possible to maintain the reliability and the serviceable life of the semiconductor integrated circuit, even with respect to the semiconductor integrated circuit provided with a single power supply step-down circuit that integrally has the step-down circuit for the normal operation mode and the step-down circuit for the standby mode.

Other objects and further features of the present invention will be apparent from the following detailed description when read in conjunction with the accompanying drawings.

DESCRIPTION OF THE PREFERRED EMBODIMENTS

In the present invention, an LSI circuit is provided with a single power supply step-down circuit that integrally has a step-down circuit for a normal operation mode (or a first step-down circuit for a first operation mode) and a step-down circuit for a standby mode (or a second step-down circuit for a second operation mode) of the LSI circuit, so as to reduce the area occupied by the power supply step-down circuit. The current consumption of the LSI circuit is smaller in the standby mode than in the normal operation mode. The step-down circuit for the normal operation mode has a low (or lower) resistance, a high (or higher) reaction speed and a large (or larger) current consumption compared to the step-down circuit for the standby mode. The step-down circuit for the normal operation mode is activated only when the operation mode of the LSI circuit is the normal operation mode, so as to step down an input power supply voltage and to output an output voltage. On the other hand, the step-down circuit for the standby mode is activated only when the operation mode of the LSI circuit is the standby mode.

The LSI circuit is provided with an output circuit which maintains the output voltage lower than the input power supply voltage for only a predetermined time when the operation mode of the LSI circuit switches to the standby mode, so that the output voltage does not become the same potential as the input power supply voltage for a long time when the operation mode of the LSI circuit makes a transition from the normal operation mode to the standby mode.

Since the output voltage can be maintained lower than the input power supply voltage for the predetermined time when the operation mode of the LSI circuit switches to the standby mode, it is possible to prevent the relatively high input power supply voltage from being applied to the circuit part within the LSI circuit, which originally should not be applied with the input power supply voltage. Accordingly, it is possible to maintain the reliability and serviceable life of the LSI circuit.

A description will now be given of embodiments of the power supply step-down circuit and the semiconductor device according to the present invention, by referring to FIG. 3 and the subsequent figures.

Figure 1:
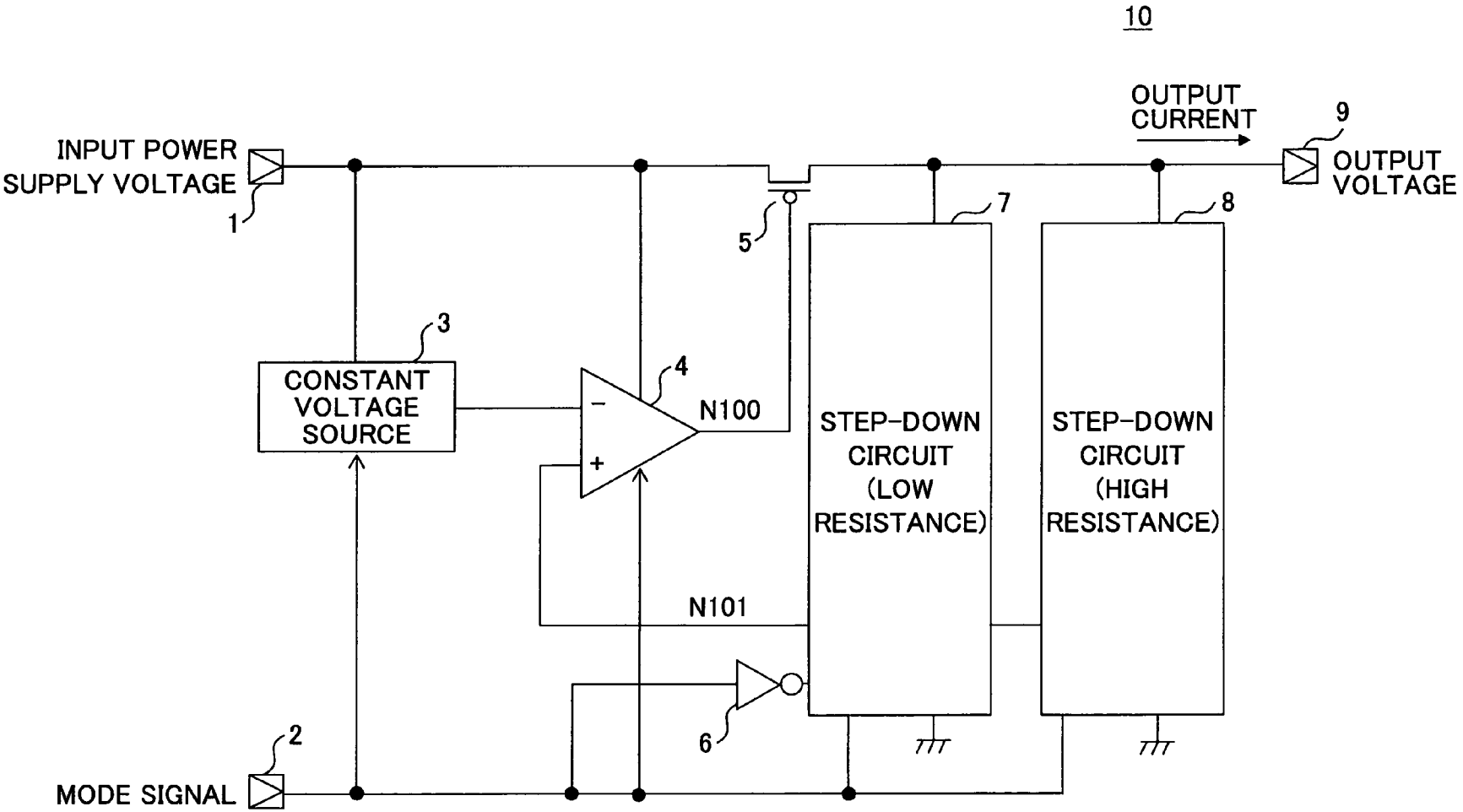
FIG. 1 is a circuit diagram showing a conceivable LSI circuit that is provided with a single power supply step-down circuit integrally having a step-down circuit for normal operation mode and a step-down circuit for standby mode.
Figure 2:
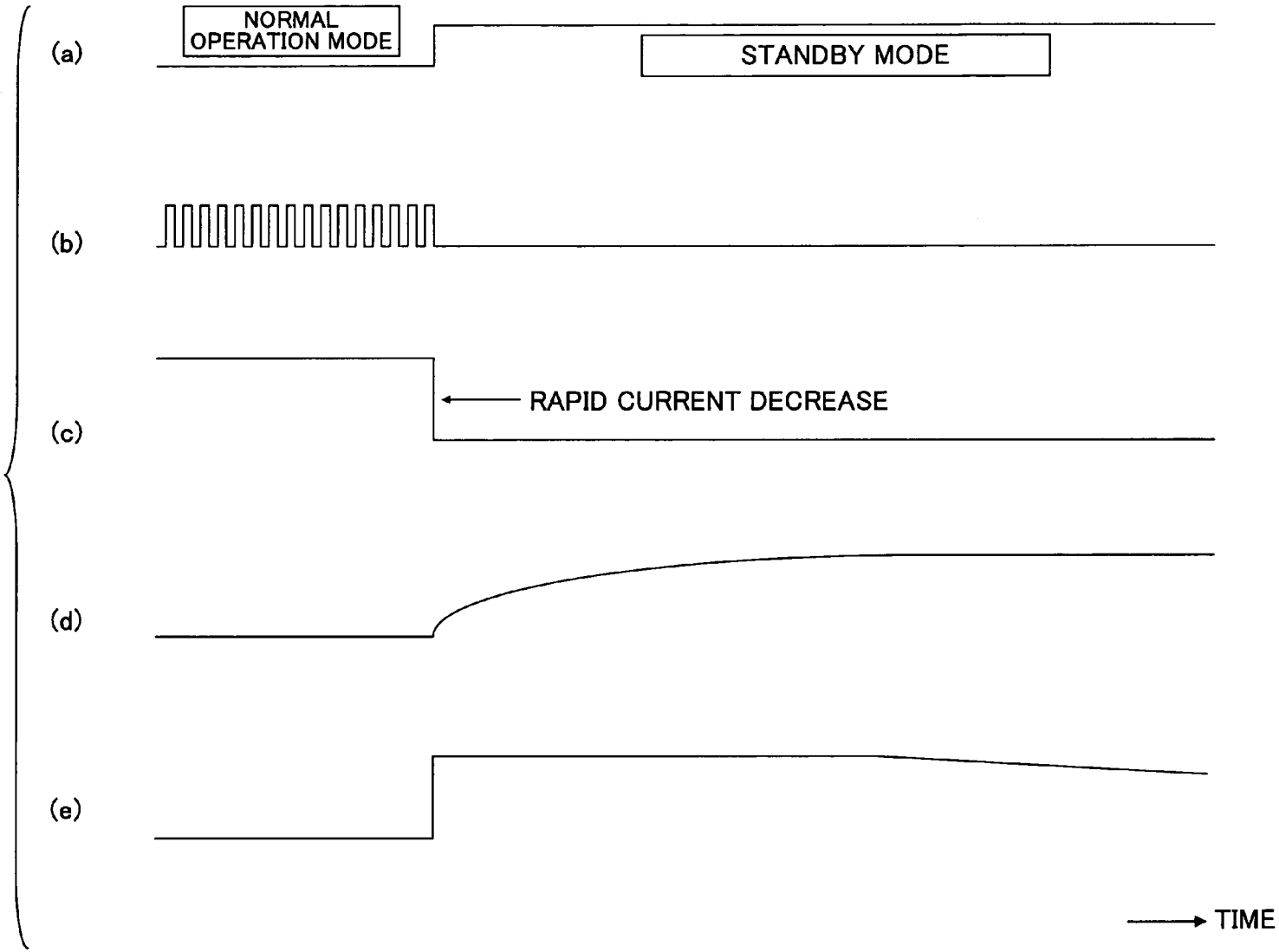
FIG. 2 is a timing chart for explaining the operation of the power supply step-down circuit shown in FIG. 1.
Figure 3:
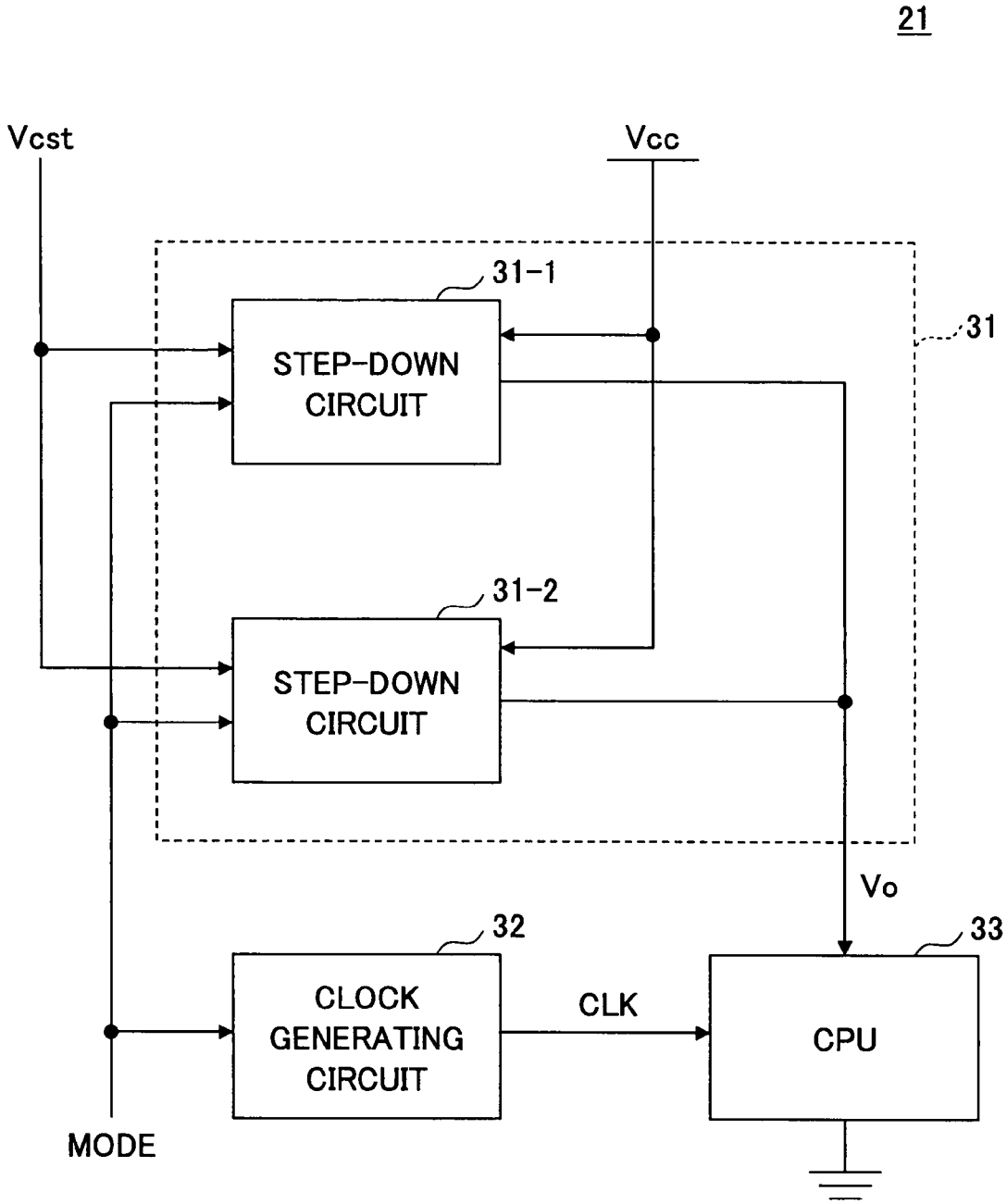
FIG. 3 is a system block diagram showing an embodiment of the present invention.

FIG. 3 is a system block diagram showing an embodiment of the present invention. A semiconductor device 21 has a single power supply step-down circuit 31, a clock generating circuit 32, and a CPU (and/or a logic circuit) 33 that are connected as shown in FIG. 3. Preferably, the power supply step-down circuit 31, the clock generating circuit 32 and the CPU 33 are provided on a common single substrate (that is, on the same substrate). In this embodiment, the power supply step-down circuit 31 integrally has a step-down circuit 31-1 for the normal operation mode and a step-down circuit 31-2 for the standby mode. A predetermined (constant) voltage Vcst and a power supply voltage Vcc are input to the power supply step-down circuit 31. A mode signal MODE which indicates whether or not the operation mode of the semiconductor device 21 is the normal operation mode or the standby mode, is input to the power supply step-down circuit 31 and the clock generating circuit 32. The clock generating circuit 32 generates a clock CLK based on the mode, signal MODE, and inputs the clock CLK to the CPU 33. The power supply step-down circuit 31 switches between the step-down circuits 31-1 and 31-2 depending on the operation mode, and supplies a stepped down output voltage Vo to the CPU 33. For example, the power supply voltage Vcc is 5 V, and the output voltage Vo that is output from the power supply step-down circuit 31 is 1.8 V.

For example, the predetermined voltage Vcst may be obtained from a constant voltage source that generates the predetermined voltage Vcst and has a current consumption that changes based on the power supply voltage Vcc and the mode signal MODE or, obtained from a constant voltage generating source that is generally referred to as a band gap reference (BGR) circuit. The circuit that generates the predetermined voltage Vcst may of course be provided within the power supply step-down circuit 31.

Figure 4:
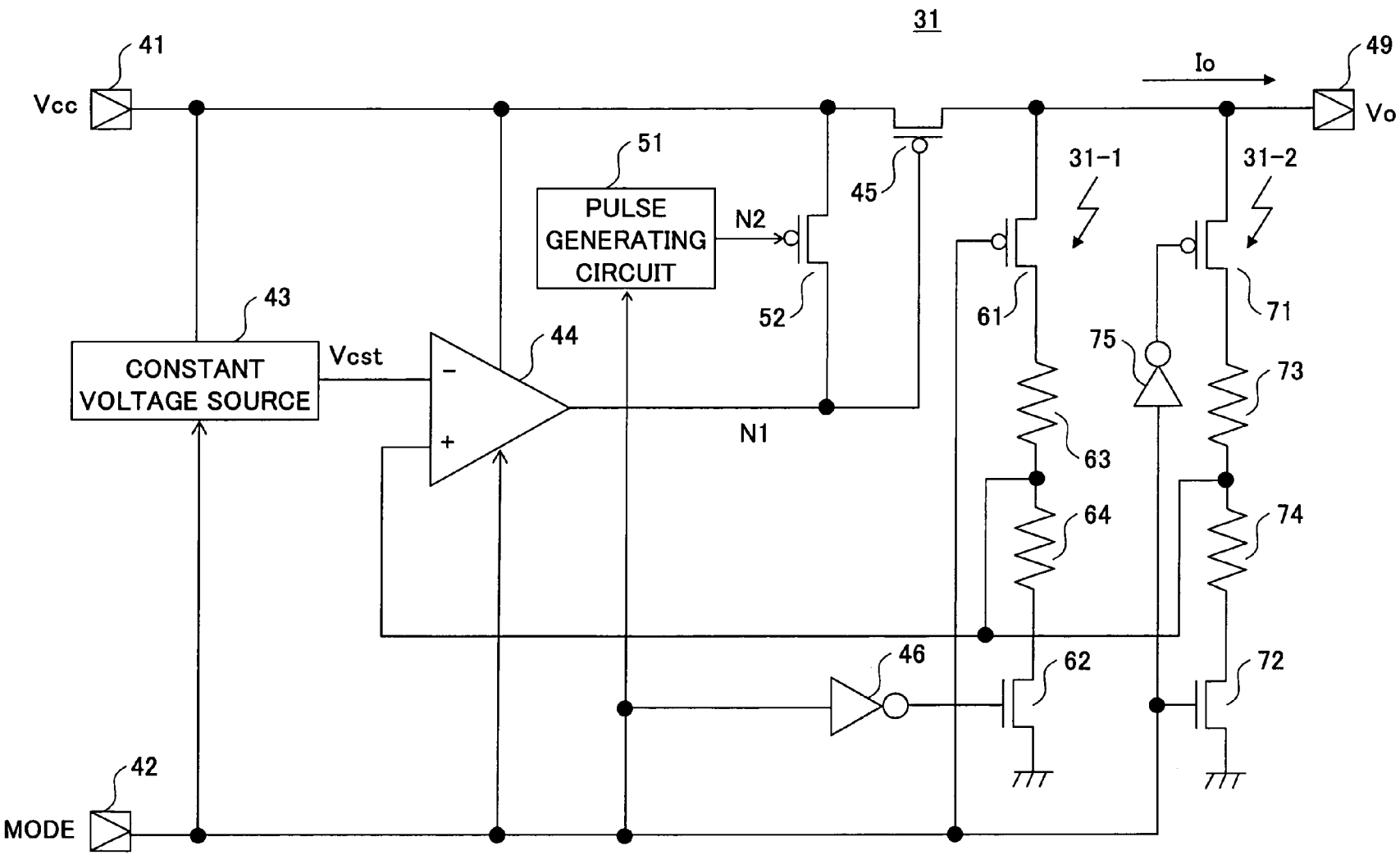
FIG. 4 is a circuit diagram showing a power supply step-down circuit.

FIG. 4 is a circuit diagram showing the power supply step-down circuit 31. The LSI circuit including the power supply step-down circuit 31 includes input terminals 41 and 42, the single power supply step-down circuit 31 integrally having the step-down circuit 31-1 for the normal operation mode and the step-down circuit 31-2 for the standby mode, and an output terminal 49 which are connected as shown in FIG. 4. The power supply step-down circuit 31 has a constant voltage source 43, a differential amplifier (or an operational amplifier) 44, an output transistor 45, an inverter 46, the step-down circuits 31-1 and 31-2, a pulse generating circuit 51, and a transistor 52. The transistors 45 and 52 are formed by P-channel transistors. The output transistor 45 is connected between the input terminal 41 and the output terminal 49. The input power supply voltage Vcc is input to the input terminal 41, and the mode signal MODE that indicates the operation mode of the LSI circuit is input to the input terminal 42.

The step-down circuit 31-1 for the normal operation mode has a series circuit connected between the output terminal 49 and the ground, where the series circuit includes a P-channel transistor 61, resistors 63 and 64 and an N-channel transistor 62 that are connected in series as shown in FIG. 4. The inverter 46 may form a portion of the step-down circuit 31-1 for the normal operation mode. On the other hand, the step-down circuit 31-2 for the standby mode has a series circuit connected between the output terminal 49 and the ground, where the series circuit includes a P-channel transistor 71, resistors 73 and 74 and an N-channel transistor 72 that are connected in series as shown in FIG. 4. The step-down circuit 31-2 for the standby mode further has an inverter 75 that is connected as shown in FIG. 4.

The constant voltage source 43 generates the predetermined voltage Vcst based on the input power supply voltage Vcc and the mode signal MODE, and inputs the predetermined voltage Vcst to an inverting input terminal of the differential amplifier 44. A voltage that is divided by the voltage-dividing resistors of the step-down circuit 31-1 for the normal operation mode or the step-down circuit 31-2 for the standby mode, is input to a non-inverting input terminal of the differential amplifier 44. An output terminal of the differential amplifier 44 and a gate of the output transistor 45 are connected via a node N1.

The mode signal MODE that is input to the input terminal 42 has a low level in the normal operation mode, and the bias current within the differential amplifier 44 and the constant voltage source 43 becomes high. Hence, the step-down circuit 31-1 for the normal operation mode, having the low resistance, is selected and activated, while the step-down circuit 31-2 for the standby mode is deactivated. On the other and, when the mode signal MODE having a high level and indicating the standby mode is input to the input terminal 42, the bias current within the differential amplifier 44 and the constant voltage source 43 becomes low. Thus, the step-down circuit 31-1 for the normal operation mode is deactivated, and the step-down circuit 31-2 for the standby mode, having the high resistance, is selected and activated.

When employing a structure of the power supply step-down circuit 31 that does not control the internal current thereof by the mode signal MODE, it is unnecessary to supply the mode signal MODE to the constant power supply source 43 and the differential amplifier 44.

The mode signal MODE from the input terminal 42 is input to the pulse generating circuit 51. An output terminal of the pulse generating circuit 51 and a gate of the transistor 52 are connected via a node N2. The transistor 52 is connected between the input terminal 41 and the node N1. An output current Io of the power supply step-down circuit 31, that is, a current consumed by the LSI circuit, flows to the output terminal 49, and the output voltage Vo which is obtained by stepping down the power supply voltage Vcc is output from the output terminal 49.

The pulse generating circuit 51 and the P-channel transistors 52 and 45 form an output circuit which maintains the output voltage Vo lower than the input power supply voltage Vcc for only a predetermined time when the operation mode of the LSI circuit switches to the standby mode, so that the output voltage Vo does not become the same potential as the input power supply voltage Vcc for a long time when the operation mode of the LSI circuit makes a transition from the normal operation mode to the standby mode.

Figure 5:
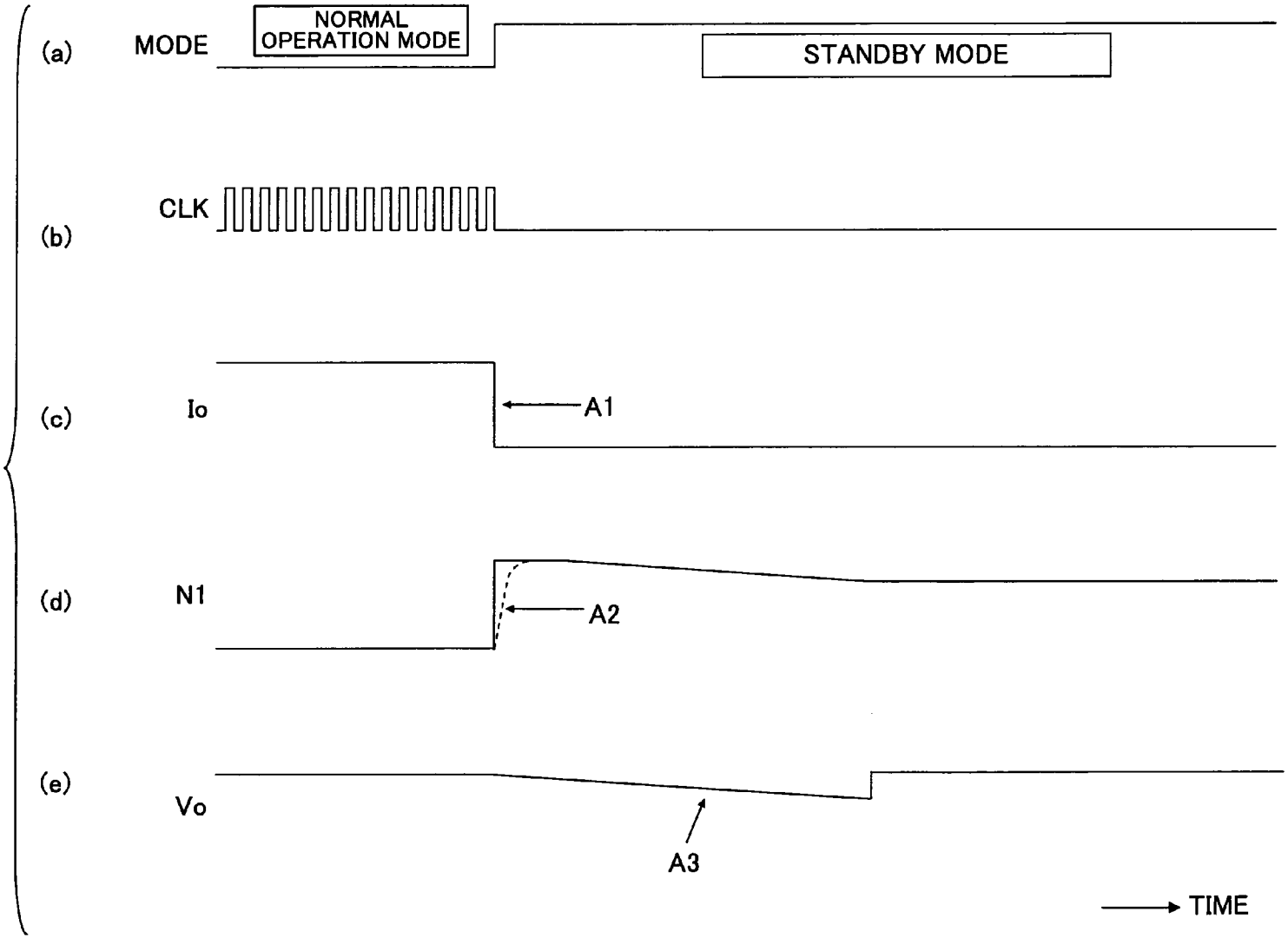
FIG. 5 is a timing chart for explaining the operation of the power supply step-down circuit.

FIG. 5 is a timing chart for explaining the operation of the power supply step-down circuit 31. In FIG. 5, (a) shows the mode signal MODE, (b) shows the clock CLK that is supplied to the circuit part, such as the CPU 33, within the LSI circuit, (c) shows the output current Io of the power supply step-down circuit 31, (d) shows the voltage at the node N1 which connects the output terminal of the differential amplifier 44 and the gate of the output transistor 45, and (e) shows the output voltage (stepped down power supply voltage) Vo that is output from the output terminal 49. FIG. 5 shows a case where the operation mode of the LSI circuit undergoes a transition from the normal operation mode to the standby mode.

As shown in FIG. 5, the during the low-level period of the mode signal MODE that indicates the normal operation mode and is input to the input terminal 42, the clock CLK is supplied to the circuit part, such as the CPU 33, within the LSI circuit. In this normal operation mode, the LSI circuit is in a state where the current consumption thereof is large, that is, the output current Io of the power supply step-down circuit 31 is high.

On the other hand, when the mode signal MODE that is input to the input terminal 42 makes a transition to the high level indicating the standby mode, the supply of the clock CLK within the LSI circuit stops, and the output current Io of the power supply step-down circuit 31 rapidly decreases as indicated by an arrow A1 in FIG. 5(*c*). In this state, the voltage at the node N1 connecting to the gate of the output transistor 45 is raised immediately as indicated by an arrow A2 in FIG. 5(*d*) so that the output voltage Vo output from the output terminal 49 will not change before and after the operation mode switches. In other words, at the same time as when the operation mode switches from the normal operation mode to the standby mode, the voltage at the node N1 is raised to the input power supply voltage Vcc. Accordingly, even though the power supply step-down circuit 31 is switched to the step-down circuit 31-2 having the slow reaction speed, it will not take time for the voltage at the node N1 to rise. In FIG. 5, (d) shows an ideal voltage waveform at the node N1, and the actual voltage waveform rises as indicated by a dotted line.

Because the voltage at the node N1 is raised t the input power supply voltage Vcc, it is possible to suppress the output voltage Vo from rising, and the output voltage Vo can be maintained to a predetermined voltage. If the voltage at the node N1 has the same potential as the input power supply voltage Vcc, the output voltage Vo will decrease with the current consumption of the LSI circuit since the output transistor 45 is turned OFF completely. But because the LSI circuit is operating in the standby mode, the amount of decrease of the output voltage Vo is 0.3 V or less, for example, and is extremely small as indicated by an arrow A3 in FIG. 5(*e*). The voltage at the node N1 decreases from the input power supply voltage Vcc depending on the decrease of the output voltage Vo, and finally stabilizes to a certain voltage. At a point in time when the voltage at the node N1 stabilizes, the output voltage Vo also stabilizes to a predetermined voltage from the decreased state. For example, if the end of the output terminal 49 is represented by an equivalent circuit that is made up of a parallel circuit which is connected between the output terminal 49 and the ground, where the parallel circuit is formed by a capacitor having a capacitance of 0.1 μF and a resistor, the current flowing through this resistor is 100 μA. Further, if the amount of decrease of the output voltage Vo in FIG. 5(*e*) is 0.2 V, the time period in which the output voltage Vo decreases as indicated by the arrow A3 us approximately 200 μsec.

Figure 6:
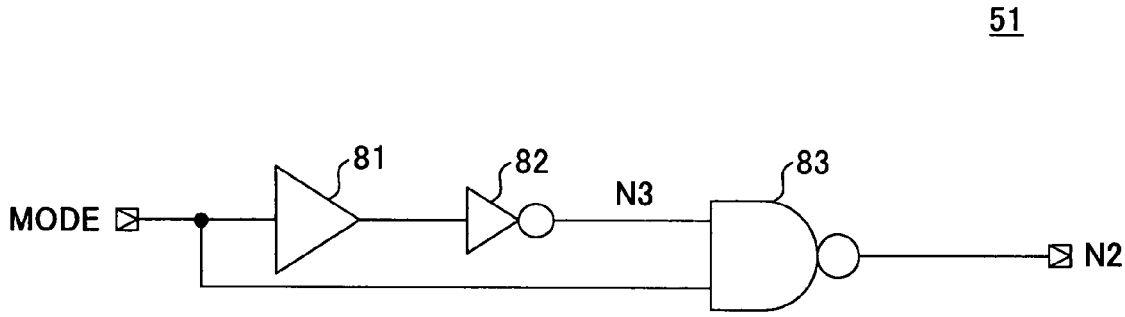
FIG. 6 is a circuit diagram showing a pulse generating circuit.

FIG. 6 is a circuit diagram showing the pulse generating circuit 51. The pulse generating circuit 51 has a delay circuit 81, an inverter 82, and a NAND circuit 83 that are connected as shown in FIG. 6. The mode signal MODE from the input terminal 42 is input to an input terminal of the delay circuit 81 and to one input terminal of the NAND circuit 83. The inverter 82 is connected between an output terminal of the delay circuit 81 and the other input terminal of the NAND circuit 83. The inverter 82 and the NAND circuit 83 are connected via a node N3. An output terminal of the NAND circuit 83 is connected to the node N2.

Figure 7:
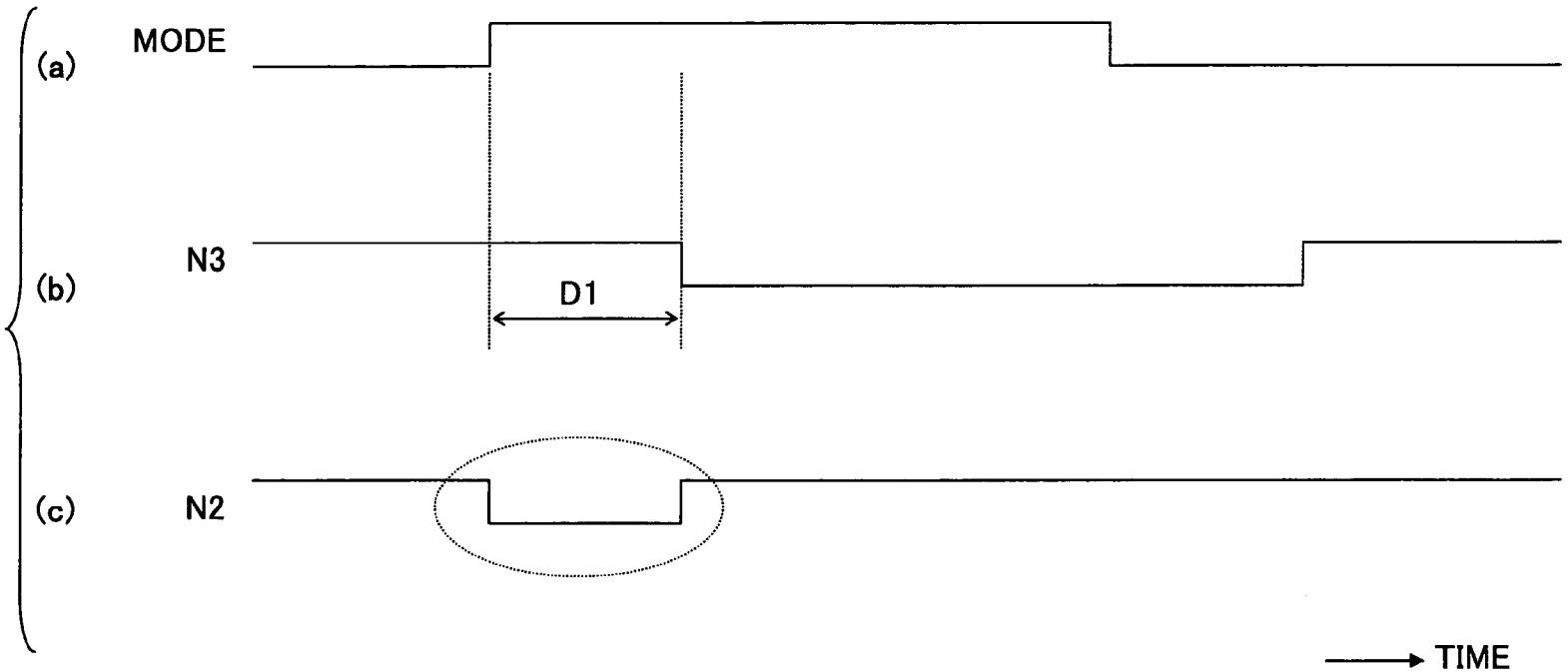
FIG. 7 is a timing chart for explaining the operation of the pulse generating circuit.

FIG. 7 is a timing chart for explaining the operation of the pulse generating circuit 51. In FIG. 7, (a) shows the mode signal MODE, (b) shows the voltage at the node N3, and (c) shows the voltage at the node N2. In FIG. 7(*b*), D1 denotes a delay time (amount of delay) of the delay circuit 81. Further, in FIG. 7(*c*), the pulse that is output from the pulse generating circuit 51 to forcibly make the voltage at the node N1 the same potential as the input power supply voltage Vcc for the delay time D1 is surrounded by a dotted line.

As shown in FIG. 4, the node N2 shown in FIG. 6 is connected to the gate of the P-channel transistor 52 that is connected between the input terminal 41 and the node N1. For this reason, the voltage at the node N1 is forcibly set to the same potential as the input power supply voltage Vcc only during the low-level period of the voltage at the node N2 shown in FIG. 6.

The time period (that is, the output pulse width of the pulse generating circuit 51) in which the voltage at the node N1 is forcibly set to the same potential as the input power supply voltage Vcc, is variable by adjusting the delay time D1 shown in FIG. 7(*b*). According to the experiments conducted by the present inventor, however, it was confirmed through simulation that it is sufficient to set the delay time D1 to approximately 1 μsec. In other words, it was confirmed that approximately 1 μsec is a sufficiently long time (delay time D1) for the output voltage Vo to be maintained lower than the input power supply voltage Vcc when the operation mode is switched to the standby mode, for the purposes of preventing the output voltage Vo from becoming the same potential as the input power supply voltage Vcc for a long time when the operation mode of the LSI circuit makes a transition from the normal operation mode to the standby mode.

This application claims the benefit of a Japanese Patent Application No.2006-247106 filed Sep. 12, 2006, in the Japanese Patent Office, the disclosure of which is hereby incorporated by reference.

Further, the present invention is not limited to these embodiments, but various variations and modifications may be made without departing from the scope of the present invention.

What is claimed is:

1. A power supply step-down circuit adapted to a semiconductor integrated circuit having a first operation mode and a second operation mode having a smaller current consumption than the first operation mode, comprising:

a first step-down circuit, activated only during the first operation mode, and configured to step down an input power supply voltage to an output voltage;

a second step-down circuit, provided integrally with the first step-down circuit and activated only during the second operation mode, and configured to step down the input power supply voltage to an output voltage;

an output terminal configured to output the output voltage of one of the first and second step-down circuits that is activated, said first step-down circuit having a lower resistance, higher reaction speed and a larger current consumption compared to the second step-down circuit; and an output circuit configured to maintain the output voltage that is output from the output terminal lower than the input power supply voltage for a first predetermined time when an operation mode makes a transition from the first operation mode to the second operation mode, so that the output voltage that is output from the output terminal does not become the same potential as the input power supply voltage for a second predetermined time or longer.

2. The power supply step-down circuit as claimed in claim 1, further comprising:

a first input terminal configured to receive a mode signal that indicates whether the operation mode is the first operation mode or the second operation mode, and to supply the mode signal to the first and second step-down circuits and the output circuit.

3. The power supply step-down circuit as claimed in claim 2, further comprising:

a differential amplifier configured to receive a constant voltage as a first input thereof, to receive a voltage that has been divided by voltage dividing resistors of the first and second step-down circuits as a second input thereof, and to supply an output thereof to the output circuit.

4. The power supply step-down circuit as claimed in claim 3, further comprising:

a second input terminal configured to receive the input power supply voltage, said output circuit comprising:

a pulse generating circuit configured to generate a pulse having a predetermined with reference to a point in time when the operation makes the transition from the first operation mode to the second operation mode, based on the mode signal;

a first transistor having a gate that receives the pulse and is coupled between the second input terminal and the output of the differential amplifier; and a second transistor having a gate that receives the output of the differential amplifier and is coupled between the second input terminal and the output terminal.

5. The power supply step-down circuit as claimed in claim 3, further comprising:

a constant voltage source configured to generate the constant voltage.

6. The power supply step-down circuit as claimed in claim 5, wherein the constant voltage source generates the constant voltage based on the input power supply voltage and the mode signal.

7. The power supply step-down circuit as claimed in claim 2, wherein a clock is supplied to a circuit part within the semiconductor integrated circuit during the first operation mode, and no clock is supplied to the circuit part during the second operation mode.

8. A semiconductor device comprising:

a power supply step-down circuit adapted to a semiconductor integrated circuit having a first operation mode and a second operation mode having a smaller current consumption than the first operation mode;

said power supply step-down circuit comprising:

a first step-down circuit, activated only during the first operation mode, and configured to step down an input power supply voltage to an output voltage;

a second step-down circuit, provided integrally with the first step-down circuit and activated only during the second operation mode, and configured to step down the input power supply voltage to an output voltage;

an output terminal configured to output the output voltage of one of the first and second step-down circuits that is activated, said first step-down circuit having a lower resistance, higher reaction speed and a larger current consumption compared to the second step-down circuit;

an output circuit configured to maintain the output voltage that is output from the output terminal lower than the input power supply voltage for a first predetermined time when an operation mode makes a transition from the first operation mode to the second operation mode, so that the output voltage that is output from the output terminal does not become the same potential as the input power supply voltage for a second predetermined time or longer; and a first input terminal configured to receive a mode signal that indicates whether the operation mode is the first operation mode or the second operation mode, and to supply the mode signal to the first and second step-down circuits and the output circuit; and a circuit part configured to receive the output voltage that is output from the output terminal and comprising a CPU and/or a logic circuit.

9. The semiconductor device as claimed in claim 8, wherein the power supply step-down circuit further comprises a differential amplifier configured to receive a constant voltage as a first input thereof, to receive a voltage that has been divided by voltage dividing resistors of the first and second step-down circuits as a second input thereof, and to supply an output thereof to the output circuit.

10. The semiconductor device as claimed in claim 9, wherein the power supply step-down circuit further comprises a second input terminal configured to receive the input power supply voltage, and the output circuit comprises:

a pulse generating circuit configured to generate a pulse having a predetermined with reference to a point in time when the operation makes the transition from the first operation mode to the second operation mode, based on the mode signal;

a first transistor having a gate that receives the pulse and is coupled between the second input terminal and the output of the differential amplifier; and a second transistor having a gate that receives the output of the differential amplifier and is coupled between the second input terminal and the output terminal.

11. The semiconductor device as claimed in claim 8, further comprising:

a clock generating circuit configured to generate a clock based on the mode signal, wherein said clock generating circuit supplies the clock to the circuit part during the first operation mode and supplies no clock to the circuit part during the second operation mode.

12. The semiconductor device as claimed in claim 11, wherein the power supply step-down circuit, said circuit part and said clock generating circuit are provided on a common single substrate.

13. The semiconductor device as claimed in claim 9, further comprising:

a clock generating circuit configured to generate a clock based on the mode signal, wherein said clock generating circuit supplies the clock to the circuit part during the first operation mode and supplies no clock to the circuit part during the second operation mode.

14. The semiconductor device as claimed in claim 13, wherein the power supply step-down circuit, said circuit part and said clock generating circuit are provided on a common single substrate.

15. The semiconductor device as claimed in claim 10, further comprising:

a clock generating circuit configured to generate a clock based on the mode signal, wherein said clock generating circuit supplies the clock to the circuit part during the first operation mode and supplies no clock to the circuit part during the second operation mode.

16. The semiconductor device as claimed in claim 15, wherein the power supply step-down circuit, said circuit part and said clock generating circuit are provided on a common single substrate.

* * * * *